US005803876A

United States Patent [19]

Hickman

[11] Patent Number: 5,803,876

[45] Date of Patent: Sep. 8, 1998

[54] KAYAK EXERCISE SIMULATOR

[76] Inventor: Lucille Hickman, 2937 W. Warren Blvd., Chicago, Ill. 60612

[21] Appl. No.: 915,262

[22] Filed: Aug. 20, 1997

[51] Int. Cl.[6] ..... A63B 69/06

[52] U.S. Cl. ..... 482/72; 482/100; 482/123

[58] Field of Search ..... 482/72, 73, 49, 482/146, 96, 113, 115, 100, 123; 434/247, 255, 392, 60

[56] References Cited

U.S. PATENT DOCUMENTS

| | | | |
|---|---|---|---|
| D. 352,980 | 11/1994 | Wu | 482/146 |
| 1,707,791 | 4/1929 | Anderson | 482/72 |
| 4,402,505 | 9/1983 | Young | 272/130 |
| 4,429,871 | 2/1984 | Flachner | 272/130 |
| 4,469,325 | 9/1984 | Ware | 482/72 |
| 4,632,393 | 12/1986 | Van Noord | 482/72 |
| 4,717,145 | 1/1988 | Chininis | 272/72 |
| 5,092,581 | 3/1992 | Koz | 482/72 |
| 5,284,458 | 2/1994 | Perry et al. | 482/49 |
| 5,354,251 | 10/1994 | Sleamaker | 482/96 |

FOREIGN PATENT DOCUMENTS

| | | | |
|---|---|---|---|
| 2256151 | 12/1992 | United Kingdom | 482/73 |

*Primary Examiner*—Jerome Donnelly
*Attorney, Agent, or Firm*—Goldstein & Canino

[57] ABSTRACT

A kayak exercise simulator for allowing a user to simulate the movements employed while rowing with a double bladed oar. The kayak exercise simulator comprises a base member having a platform for sitting upon, and a pivot rod having an upper pivot rod end and a lower pivot rod end, extending upward from the platform. A rowing arm having opposite ends and a center located between the opposite ends is pivotally connected at the center to the upper pivot rod end of the pivot rod. The pivotal connection permits a multitude of horizontal, vertical and circular kayak-rowing motions to be simulated upon the user sitting upon the platform, placing a leg on each opposite side of the pivot bar and grasping an end of the rowing arm with each hand. Detachable weights may be secured to the ends of the rowing arm to vary the amount of force needed to accomplish the simulated rowing exercises.

1 Claim, 2 Drawing Sheets

Fig. 2
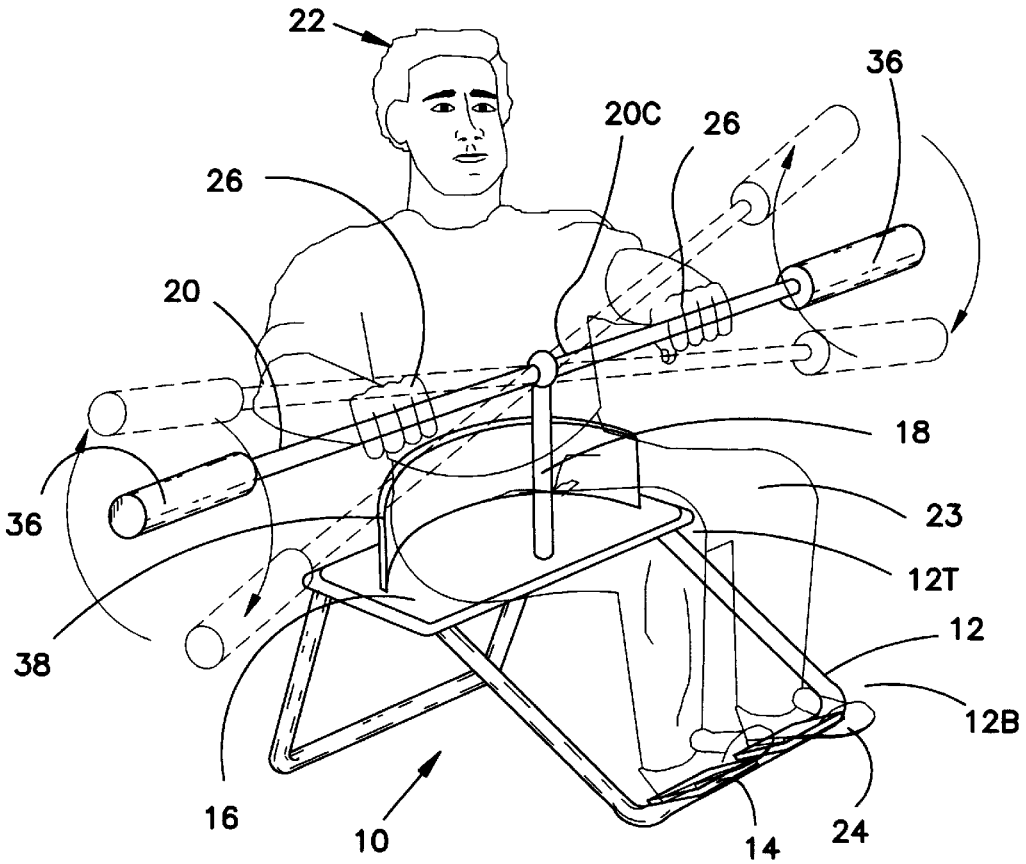
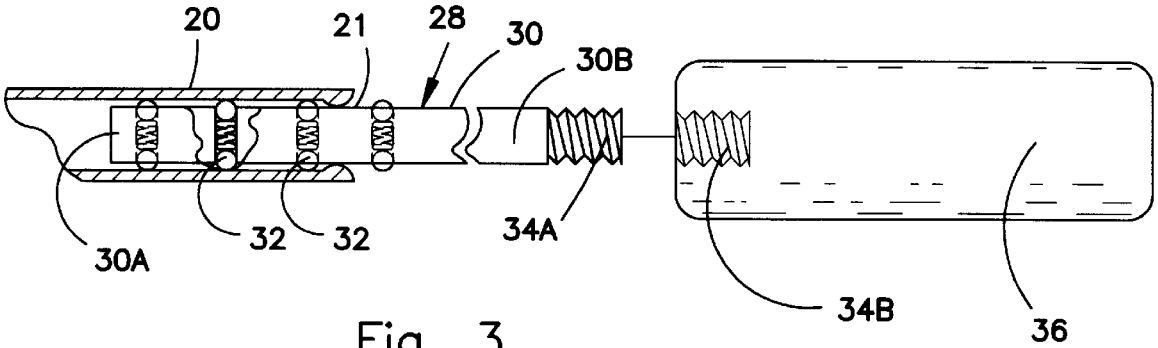
Fig. 3

KAYAK EXERCISE SIMULATOR

BACKGROUND OF THE INVENTION

The invention relates to a kayak exercise simulator. More particularly, the invention relates to a rowing-type exercise which simulates the movements encountered while waterborne kayaking.

Various types of rowing exercisers are well known in the art. Unfortunately, most exercise rowing simulators mimic the motion of rowing a scull or row boat where a pair of row oars are used. While such a double oar rowing motion does provide stimulation and hence toning to the muscles of the upper torso and abdomen, it fails to provide true muscle building and strengthening to the upper body since said motion relies primarily on the bicep muscles of the arm. In addition, the motion typically encountered while employing such a device often proves damaging to one's lower back muscles due to the repetitive leaning forward and pulling rearward task required by said devices.

U.S. Pat. No. 4,717,145 to Chininis discloses a device which simulates the motion of double-bladed oar rowing. The Chininis device, however, is complex and bulky, and employs awkward resistance cylinders. Accordingly, the Chininis device does not naturally replicate the feeling of waterborne, double bladed oar kayaking.

While these units may be suitable for the particular purpose employed, or for general use, they would not be as suitable for the purposes of the present invention as disclosed hereafter.

SUMMARY OF THE INVENTION

It is an object of the invention to produce a kayak exercise simulator.

It is a further object of the invention to produce a kayak exercise simulator which strengthens and trains the muscles of the upper torso by replicating the movements encountered while rowing with a double-bladed oar.

It is yet another object of the invention to produce a kayak exercise simulator device which is simple in design and construction.

It is a final object of the invention to produce a kayak exercise simulator device which possess variable resistances to assist a user in achieving an optimal rate of exercise.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a diagrammatic perspective view of the kayak exercise simulator of the instant invention as seen in FIG. 1, with a user seated thereupon and employing said simulator.

FIG. 3 is a view of an arm and weight attachment of the kayak exercise simulator.

DETAILED DESCRIPTION OF THE PREFERRED EMBODIMENTS

Figure 1:
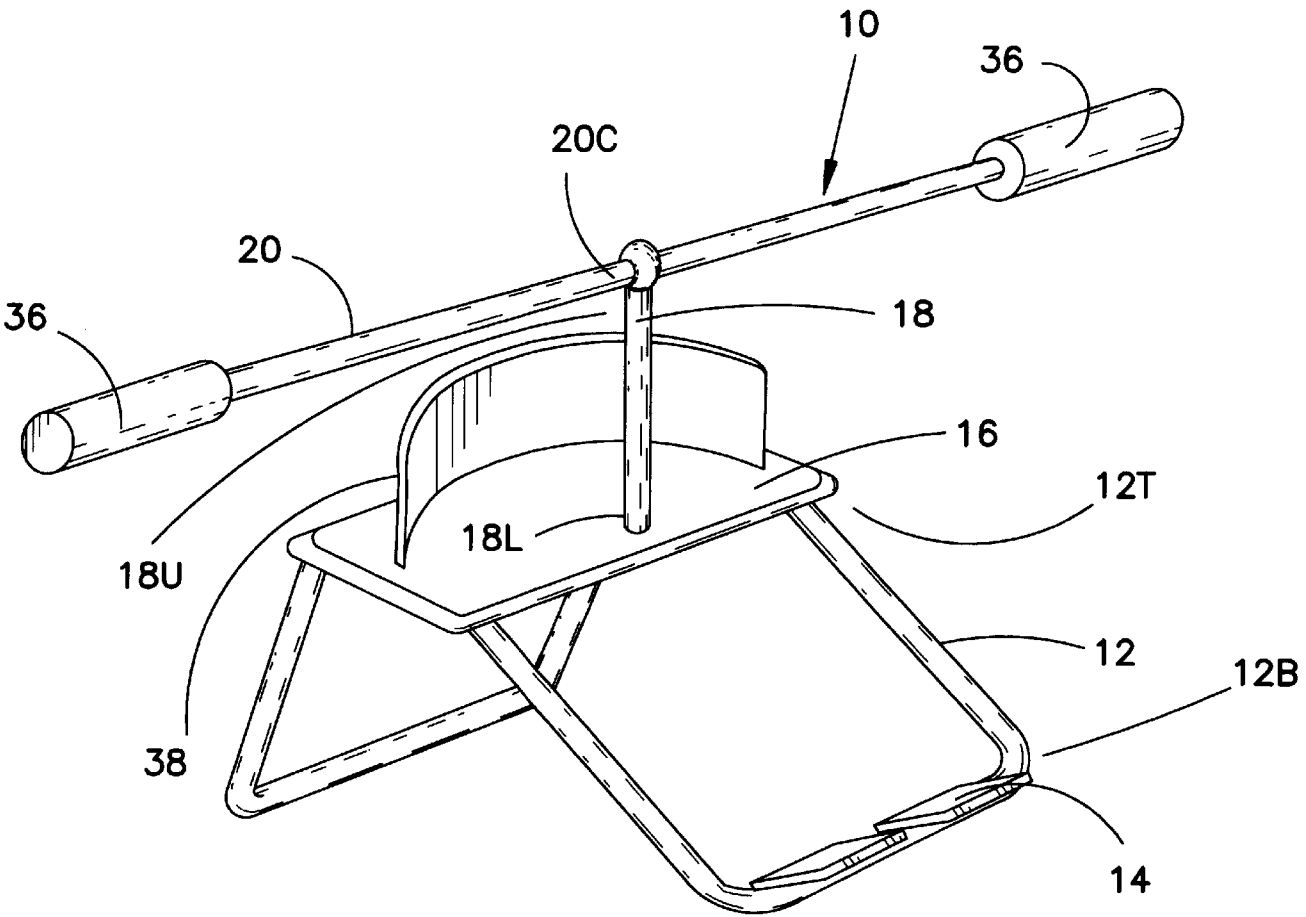
FIG. 1 is a diagrammatic perspective view of a kayak exercise simulator of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the kayak exercise simulator. The words "proximal end" and "distal end" refer, respectively, to ends of an object nearer to and further from the operator of the object when the object is used in a normal fashion or as is described in the specification.

FIG. 1 illustrates a kayak exercise simulator 10. The kayak exercise simulator 10 comprises a base member 12 having a base bottom 12B and a base top 12T. A foot rest 14 is affixed proximal to the base bottom 12B. A platform 16 for sitting upon is affixed to the base top 12, said platform 16 extending essentially parallel to the horizon. A pivot rod 18 having an upper pivot rod end 18U and opposite lower pivot rod end 18L extends upward from the platform 16 and is affixed to said platform 16 at the lower pivot rod end 18L. A rowing arm 20 having opposite ends and a center 20C located therebetween is affixed pivotally at said center 20C to the upper pivot rod end 18U. The pivotal connection of the center 20C of the rowing arm 20 to the upper end 18U of the pivot rod 18 may be achieved by manners well known to those skilled in the art, and results in said rowing arm 18 being movable to a multitude of vertical and horizontal positions, as seen clearly in FIG. 2.

FIG. 3 depicts one of the ends of the rowing arm 20. The rowing arm 20 is tubular and hollow, having an opening 21 at each end. A resistance attachment 28 comprises a resistance tube 30 having opposite ends 30A and 30B, said resistance tube lesser in diameter than the inside diameter of the rowing arm 20, so that the end 30A of the resistance tube 30 may be inserted into the opening 21 at the end of the rowing arm 20, and contained therein. A plurality of spring loaded ball bearings 32 are disposed along the periphery of the end 30A of the resistance arm 30. The opening 21 of the end of the rowing arm 20 is pinched inward so that upon inserting the end 30A of the resistance tube 30 into the opening 21, the pinched segment will compress the spring loaded ball bearing 32 until said spring loaded ball bearing 32 passes thereby. Once passing thereby, the spring loaded ball bearing 32 will decompress, butting against the inwardly pinched opening and preventing the resistance tube 30 from being withdrawn from the interior of the rowing arm 20.

The opposite end 30B of the resistance tube 30 has threads 34A inscribed thereupon. A weight component 36 has corresponding threads 34B bored in the center thereof, so that said weight component 36 may be removeably secured to the end 30B of the resistance tube. Accordingly, two distinct modes of variable resistance are provided. The removable weight component 36 may comprises a mass of any number of various weights, and thus the desired weight mass weight component 36 may be secured to the end 30B of the resistance tube 30. In addition, by extending or retracting the amount of the resistance tube 30 which extends into the opening 21 of the end of the rowing arm 20, the amount of force needed to be applied thereto to accomplish a fixed amount of movement will also vary.

Operation and utilization of the kayak exercise simulator 10 is discussed with reference to FIG. 2. In FIG. 2, a user 22 is shown seated upon the platform 16 of the kayak exercise simulator 10. Each of the user's legs 23 extend upon opposite sides of the pivot rod 18, and feet 24 of the user 22 are placed upon the foot rest 14 located at the base bottom 12B. A hand 26 of the user 22 grasps the rowing arm 20 on each side of the pivot rod 18, between the center 20C of the rowing arm 20 and each end, as seen in FIG. 2. Accordingly, simulated kayak rowing motions can be achieved, wherein the user 22 moves the ends of the rowing arm 20 in side-to-side circular movements. A back support member 38 may optionally extend vertically upwards from the platform 16 to maintain the user's 22 position upon the platform 16.

What is claimed is:

1. A kayak exercise simulator, for allowing a user to simulate the movements employed while rowing with a double bladed oar, comprising:

a) a base member having a base member bottom and a base member top;

b) a platform, extending parallel to the horizon, affixed to the base member top for allowing the user to be seated thereupon;

c) a pivot rod having an upper pivot rod end and an opposite lower pivot rod end, the lower pivot rod end secured to the platform, the pivot rod extending upward therefrom;

d) a rowing arm, tubular in shape, having opposite ends and a center located therebetween, each opposite end having an opening which is pinched inward located thereat for accepting a resistance attachment the opposite ends of the rowing arm pivotally connected at said center to the upper pivot rod end of the pivot rod, wherein said pivotal connection permits a multitude of horizontal, vertical and circular kayak-rowing motions to be simulated upon the user sitting upon the platform, placing a leg on each opposite side of the pivot bar and grasping an end of the rowing arm with each hand; and e) the resistance attachment having a resistance tube with opposite ends, the first end accepted into the opening of the rowing arm having a plurality of spring loaded ball bearings disposed upon the periphery thereof, so that upon inserting the end of the resistance tube into the pinched opening, the pinched segment will compress the spring loaded ball bearing until said spring loaded ball bearing passes thereby, and upon passing thereby the spring loaded ball bearing will decompress, butting against the inwardly pinched opening and preventing the resistance tube from being withdrawn from the interior of the rowing arm, whereby upon extending or retracting the amount of the resistance tube which extends into the opening of the end of the rowing arm, the amount of force needed to be applied thereto to accomplish a fixed amount of movement will vary, and the second opposite end threaded for removeably engaging a correspondingly threaded weight component, whereby weight components of various weight may be interchangeably secured to the threaded end of the resistance tube, thus varying the amount of force needed to be applied thereto to propel said end.

* * * * *